US011471739B2

(12) United States Patent
Wu

(10) Patent No.: US 11,471,739 B2
(45) Date of Patent: Oct. 18, 2022

(54) PUNCHING-TRAINING DEVICE

(71) Applicant: Azuni International Co., Ltd., Taichung (TW)

(72) Inventor: Li-Chin Wu, Taichung (TW)

(73) Assignee: AZUNI INTERNATIONAL CO., LTD., Taichung (TW)

( * ) Notice: Subject to any disclaimer, the term of this patent is extended or adjusted under 35 U.S.C. 154(b) by 319 days.

(21) Appl. No.: 16/817,867

(22) Filed: Mar. 13, 2020

(65) Prior Publication Data

US 2021/0283482 A1 Sep. 16, 2021

(51) Int. Cl.

| | |
|---|---|
| ***A63B 69/34*** | (2006.01) |
| ***A63B 69/00*** | (2006.01) |
| ***A63B 71/02*** | (2006.01) |
| *A63B 22/00* | (2006.01) |

(52) U.S. Cl.

CPC ..... *A63B 69/34* (2013.01); *A63B 69/004* (2013.01); *A63B 71/023* (2013.01); *A63B 22/0002* (2013.01); *A63B 2071/026* (2013.01); *A63B 2209/10* (2013.01); *A63B 2225/09* (2013.01); *A63B 2244/10* (2013.01)

(58) Field of Classification Search

CPC ..... A63B 69/004; A63B 69/34; A63B 71/023; A63B 2071/026; A63B 2209/10; A63B 2225/09; A63B 2225/093; A63B 2244/10; A63B 22/0002

See application file for complete search history.

(56) References Cited

U.S. PATENT DOCUMENTS

| | | | | |
|---|---|---|---|---|
| 2014/0128226 | A1* | 5/2014 | Chang | A63B 71/023 482/83 |
| 2014/0302969 | A1* | 10/2014 | Chen | A63B 69/34 482/90 |
| 2017/0348577 | A1* | 12/2017 | Chen | A63B 69/208 |
| 2018/0021650 | A1* | 1/2018 | Hoover | A63B 69/004 482/83 |
| 2021/0178239 | A1* | 6/2021 | Chen | A63B 69/20 |

* cited by examiner

*Primary Examiner* — Megan Anderson

(74) *Attorney, Agent, or Firm* — Muncy, Geissler, Olds & Lowe, P.C.

(57) ABSTRACT

A punching-training device is provided, including: a support body, having a seat end and an assembling end; and a punching mechanism, including a first punched member which is freely rotatably assembled to the assembling end and a pad, the first punched member including a body portion disposed around the assembling end, the pad being disposed on and rotatable together with the body portion.

10 Claims, 7 Drawing Sheets

PUNCHING-TRAINING DEVICE

BACKGROUND OF THE INVENTION

Field of the Invention

The present invention relates to a punching-training device.

Description of the Prior Art

Conventionally, a hit-practicing device has a target for a user to practice striking skills.

In a conventional hit-practicing device, the target is only positioned at one position, so that the user cannot adjust the target, and it is boring to do hitting training, easily.

The present invention is, therefore, arisen to obviate or at least mitigate the above-mentioned disadvantages.

SUMMARY OF THE INVENTION

The main object of the present invention is to provide a punching-training device having various and adjustable training modes.

To achieve the above and other objects, a punching-training device is provided, including: a support body, having a seat end and an assembling end; and a punching mechanism, including a first punched member which is freely rotatably assembled to the assembling end and a pad, the first punched member including a body portion disposed around the assembling end, the pad being disposed on and rotatable together with the body portion.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
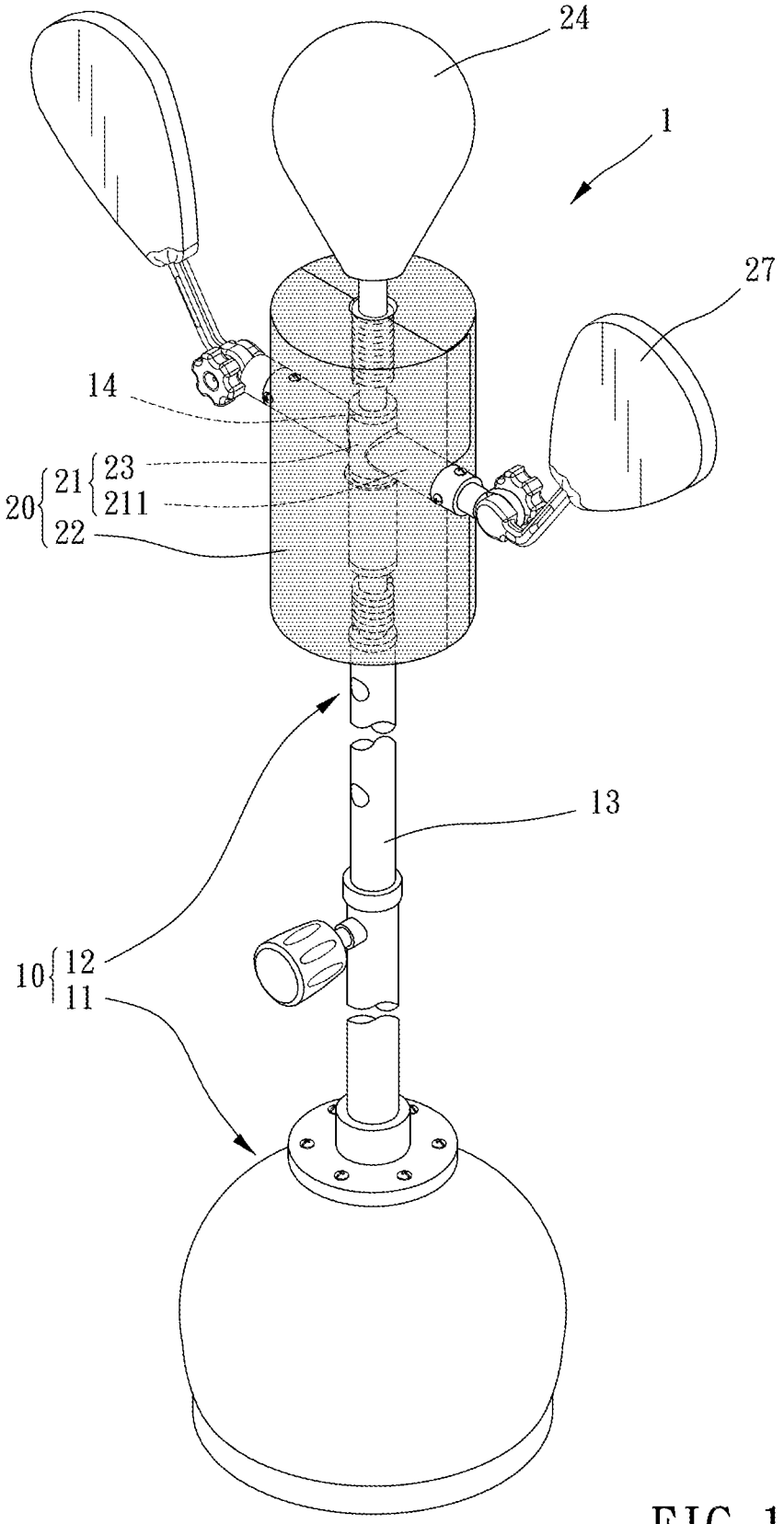
FIG. 1 is a stereogram of a preferable embodiment of the present invention.
Figure 2:
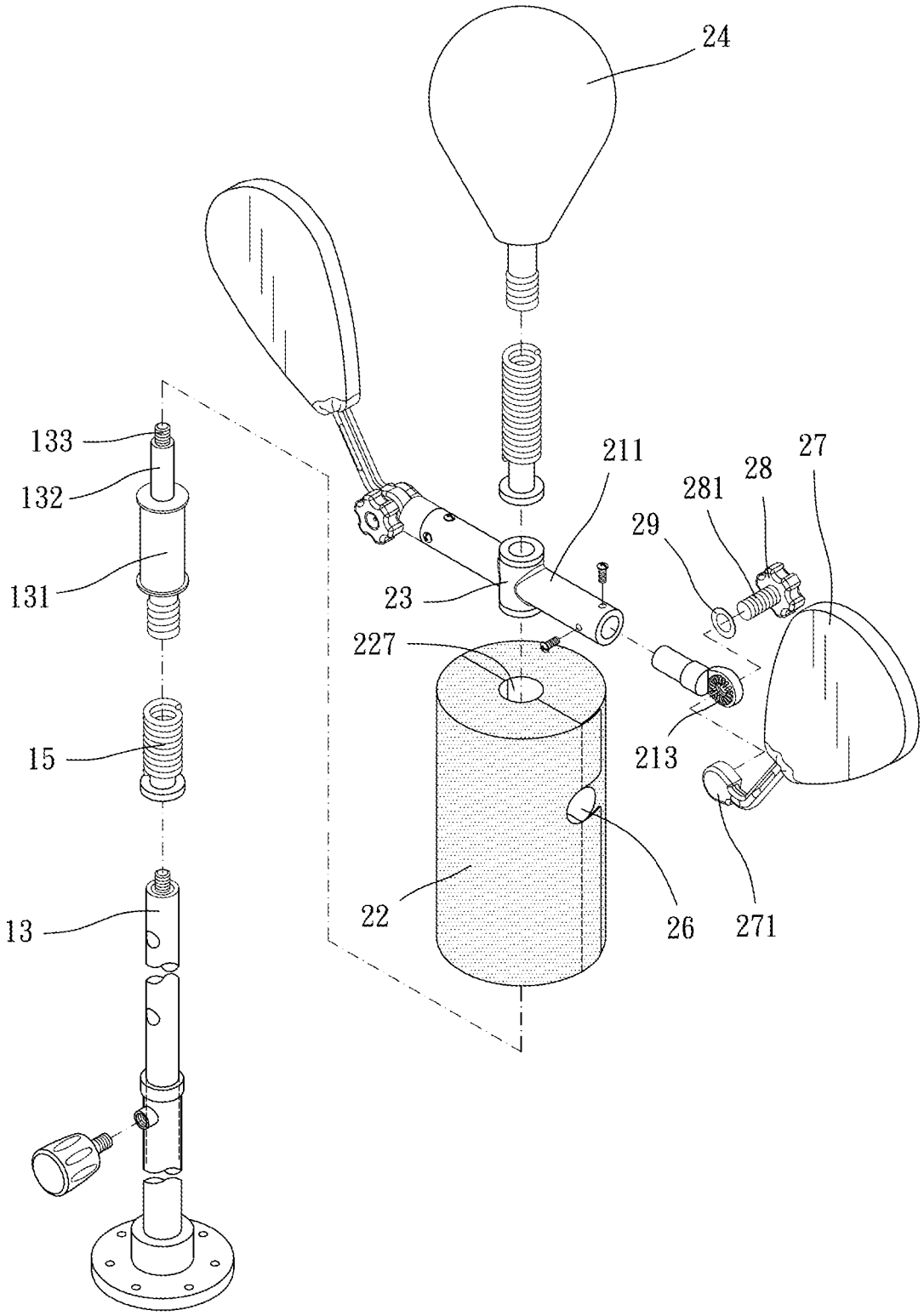
FIG. 2 is a breakdown drawing of a preferable embodiment of the present invention.
Figure 3:
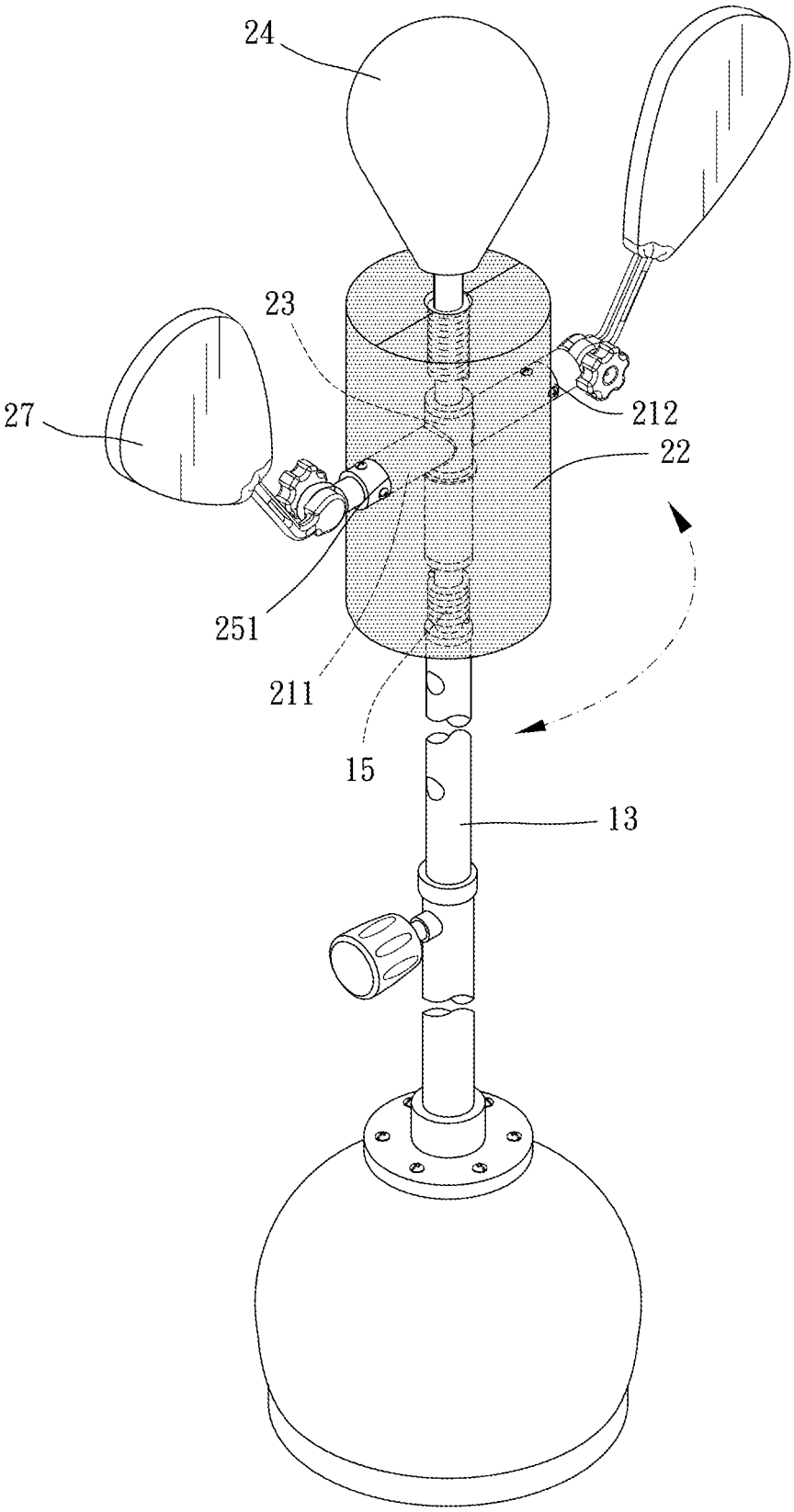
FIG. 3 is a stereogram of a preferable embodiment of the present invention in use.
Figure 4:
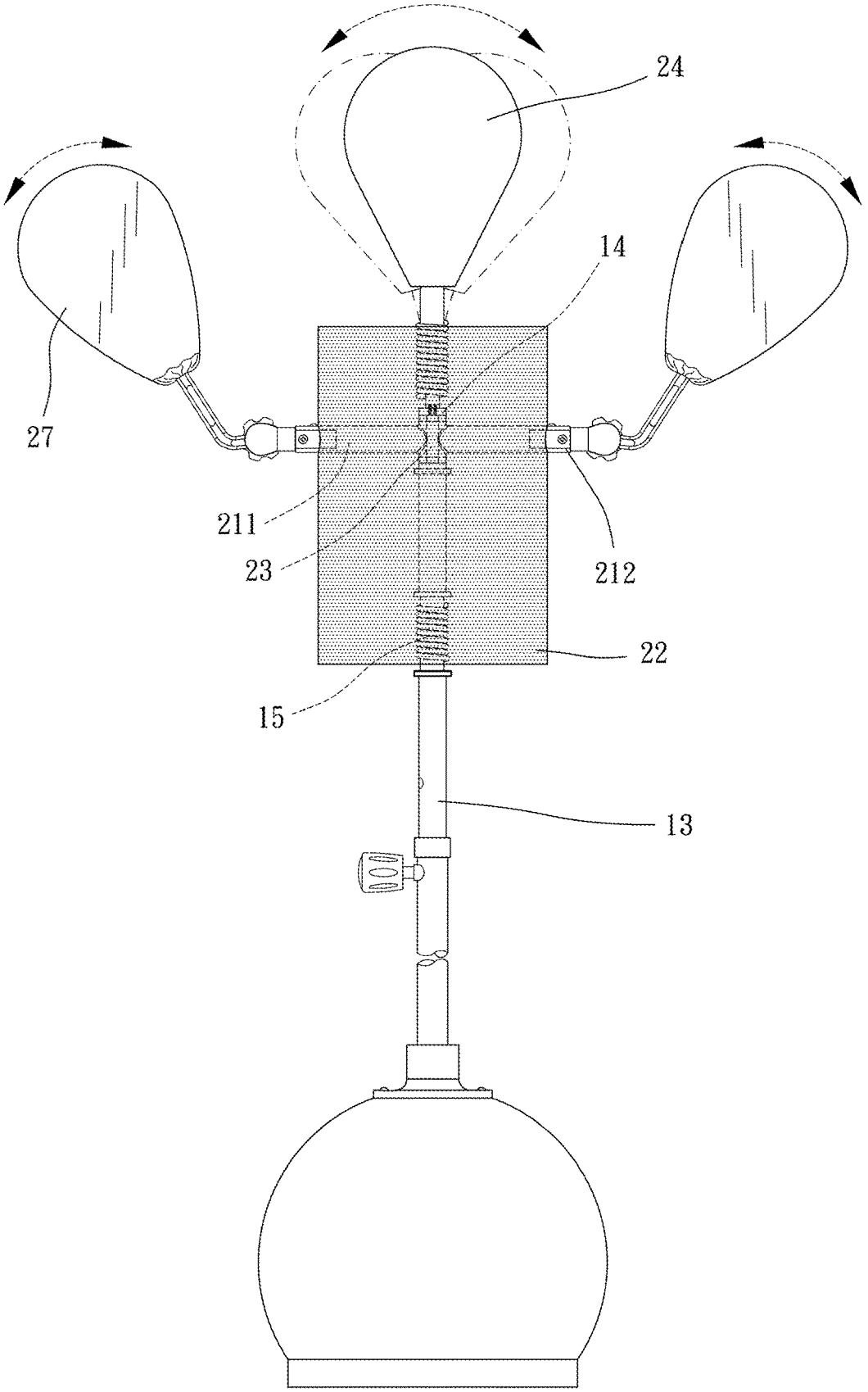
FIG. 4 is a side view of a preferable embodiment of the present invention in use.
Figure 5:
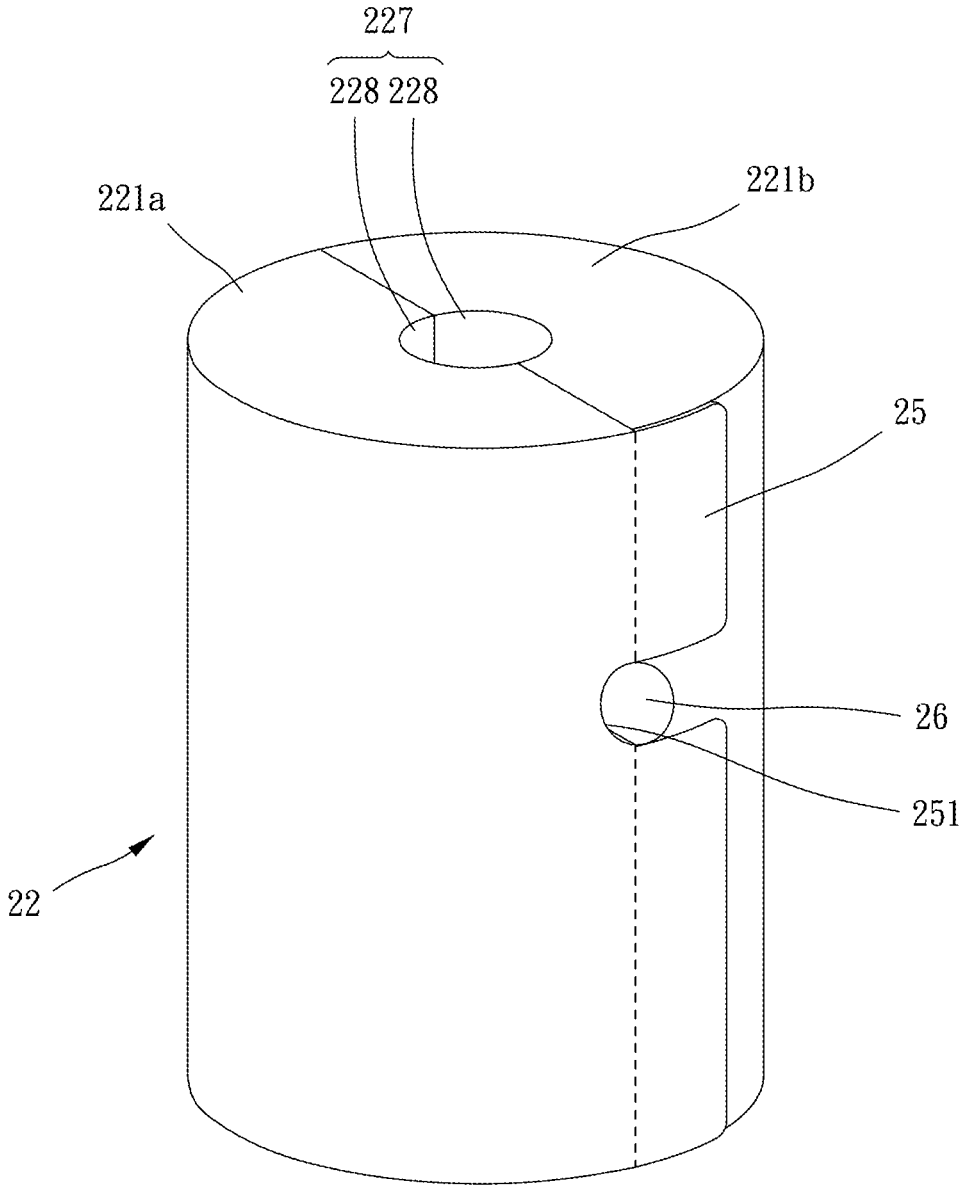
FIG. 5 is a stereogram of a pad according a preferable embodiment of the present invention.
Figure 6:
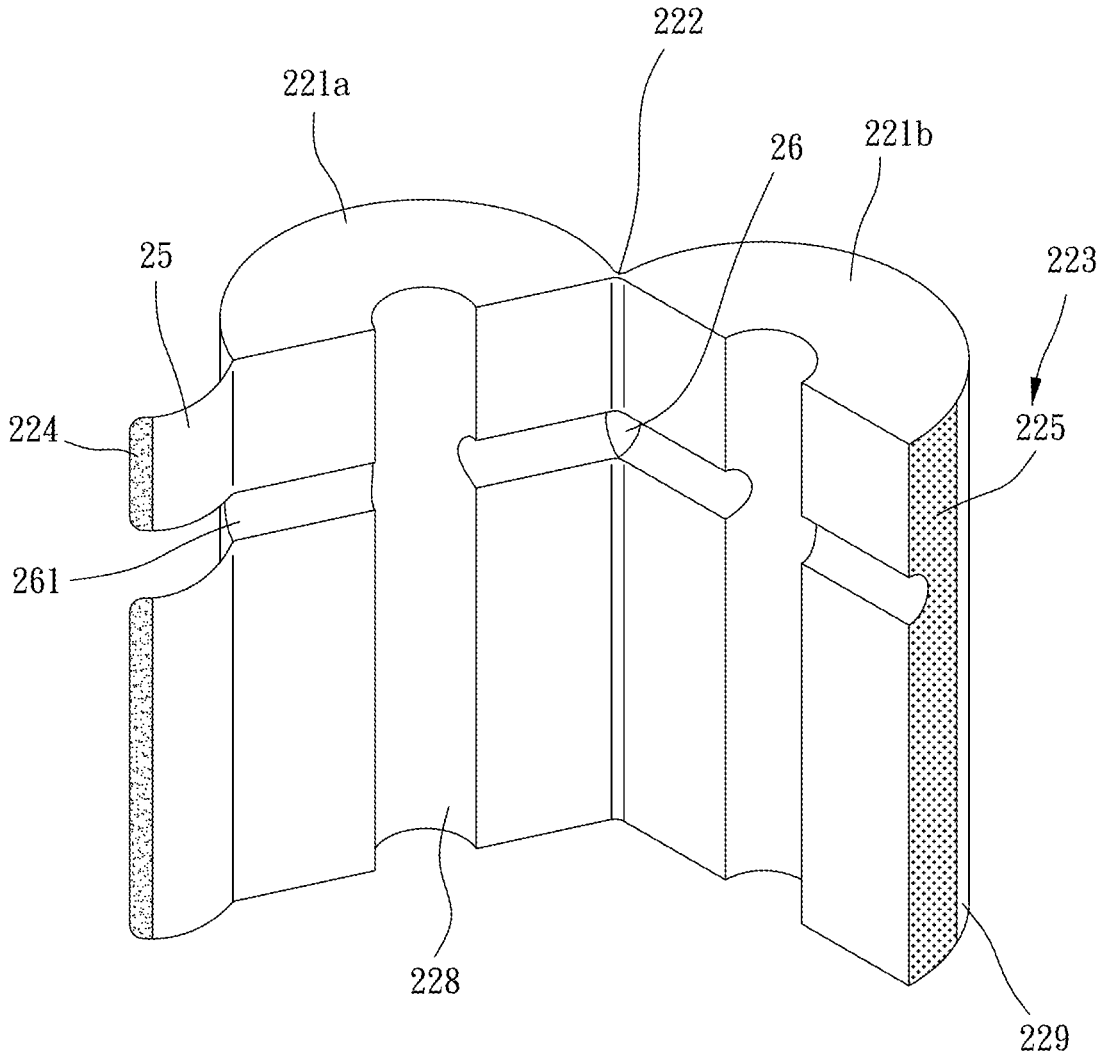
FIG. 6 is a stereogram of the pad in an open state according a preferable embodiment of the present invention.

Please refer to FIGS. 1 to 6 for a preferable embodiment of the present invention. A punching-training device 1 of the present invention includes a support body 10 and a punching mechanism 20.

The support body 10 includes a seat end 11 and an assembling end 12. The punching mechanism 20 includes a first punched member 21 which is freely rotatably assembled to the assembling end 12 and a pad 22, the first punched member 21 includes a body portion 23 disposed around the assembling end 12, and the pad 22 is disposed on and rotatable together with the body portion 23. The first punched member 21 and the pad 22 may be totally freely rotatable for 360 degrees or a limited angle of certain degrees. Whereby, it can meet needs of various positions and angles of target for punching.

The pad 22 may be tubular, humanoid or the like, for fun. The filling inside the pad 22 may be high-density foam or other flexible materials.

The assembling end 12 further includes a supporting rod 13 and a stop portion 14, the supporting rod 13 includes a large diameter section 131, a small diameter shaft 132 connected with the large diameter section 131 and a connection end 133 disposed at an end of the small diameter shaft 132. The first punched member 21 is rotatably mounted to the small diameter shaft 132, the stop portion 14 is detachably connected with the connection end 133, and the pad 22 covers the stop portion 14, which can preventing hitting on the stop portion 14 so that parts cannot be loosen easily. The stop portion 14 may further include an additional punched member 24, wherein the punched member 24 may be the same with or different from the first punched member 21.

The supporting rod 13 is retractable, which allows adjustment height of the punched members 21 and 24 for punching. The large diameter section 131 may be integrally formed or detachably connected with the small diameter shaft 132 and the connection end 133. The connection end 133 is smaller than the small diameter shaft 132 in radius, thus being capable of restricting assembling position without any additional elements.

The pad 22 is detachably disposed on the body portion 23, the pad 22 includes two cladding portions 221*a*, 221*b* which are openably connected with each other, and the body portion 23 is disposed between the two cladding portions 221*a*, 221*b*. The pad 22 further includes an intermediate connection portion 222 connected between the two cladding portions 221*a*, 221*b*, and the two cladding portions 221*a*, 221*b* are swingable about the intermediate connection portion 222, which facilitating assembling/disassembling and providing easy mounting of the two cladding portions 221*a*, 221*b* onto any of various types or sizes of body portions. The intermediate connection portion 222 is thinner than each of the two cladding portions 221*a*, 221*b*. The intermediate connection portion 222 may be made of deformable material such plastic material, thus providing good fitting and combination of the two cladding portions 221*a*, 221*b*. The punching-training device may include more than two cladding portions.

The pad 22 further includes a bonding structure 223, the bonding structure 223 includes a male bonding structure 224 and a female bonding structure 225 detachably the male bonding structure 224. The male bonding structure 224 is disposed on a first one of the two cladding portions 221*a*, 221*b*, and the female bonding structure 225 is disposed on a second one of the two cladding portions 221*a*, 221*b*. In this embodiment, the male bonding structure 224 is a hook structure of Velcro, and the female bonding structure 225 is a loop structure of Velcro, which is advantageous to quick mounting or demounting. In an alternative embodiment, the male and female bonding structures may be male and female buckle members, respectively. The pad 22 further includes a band 25, the band 25 is flexible, the band 25 is connected with the cladding portion 221*a*, one of the band 25 and the cladding portion 221*b* includes the male bonding structure 224, and the other of the band 25 and the cladding portion 221*b* includes the female bonding structure 225.

The pad 22 further includes a penetrating hole 227, the body portion 23 is received in the penetrating hole 227; each of the two cladding portions 221*a*, 221*b* includes a longitudinal groove 228, the longitudinal groove 228 of the two cladding portions 221*a*, 221*b* form the penetrating hole 227, and the body portion 23 can be stably held between the longitudinal grooves 228.

The first punched member 21 further includes two arm portions 211, the body portion 23 is a tubular member, the two arm portions 211 are laterally connected with the tubular member, and the pad 22 covers the two arm portions 211; the two arm portion 211*s* are disposed respectively at two opposite sides of the tubular member; the pad 22 includes two through holes 26 corresponding respectively to the two arm portions 211, and the two arm portions 211 are received respectively within the two through holes 26; each of the two cladding portion 221*a*, 221*b* further includes two lateral grooves 261, and corresponding two of said lateral grooves 261 of the two cladding portions 221*a*, 221*b* form one said through hole 26; the band 25 includes a notch 251, one of the two arm portions 211 is received in the notch 251, the two arm portions 211 can stably support the pad 22. A respective distal end 212 of each of the two arm portions 211 is protrusive outwardly beyond one said through hole 26, for mounting punched members easily.

The punching mechanism 20 further includes two second punched members 27, two fasteners 28 and two washers 29. Each of the two arm portions 211 includes a first engagement portion 213, each of the two second punched members 27 includes second engagement portion 271 adjustably engaged with the first engagement portion 213. Each of the two fasteners 28 is disposed through one said first engagement portion 213 and one said second engagement portion 271 and serves as a shaft portion 281. Each of the two washers 29 is disposed between one said second punched member 27 and one said fastener 28, one of the two fasteners 28 is abutted against one said washer 29, and each of the two second punched members 27 is rotatable relative to the first engagement portion 213 about the shaft portion 281, in which the first engagement portion 213 and the second engagement portion 271 cooperate to allow rotatable and angular adjustment of the punched members. In this embodiment, the first engagement portion 213 and the second engagement portion 271 include toothed structures which are engageable with and disengageable from each other. The two second punched members 27 can be mounted at respective distal ends 212 of the two arm portion 211.

The support body 10 further includes a buffering mechanism 15, the buffering mechanism 15 is disposed between the seat end 11 and the first punched member 21, and the pad 22 covers the buffering mechanism 15, which providing buffering and impact-absorbing. The buffering mechanism 15 is preferably a spring for recovery.

Figure 7:
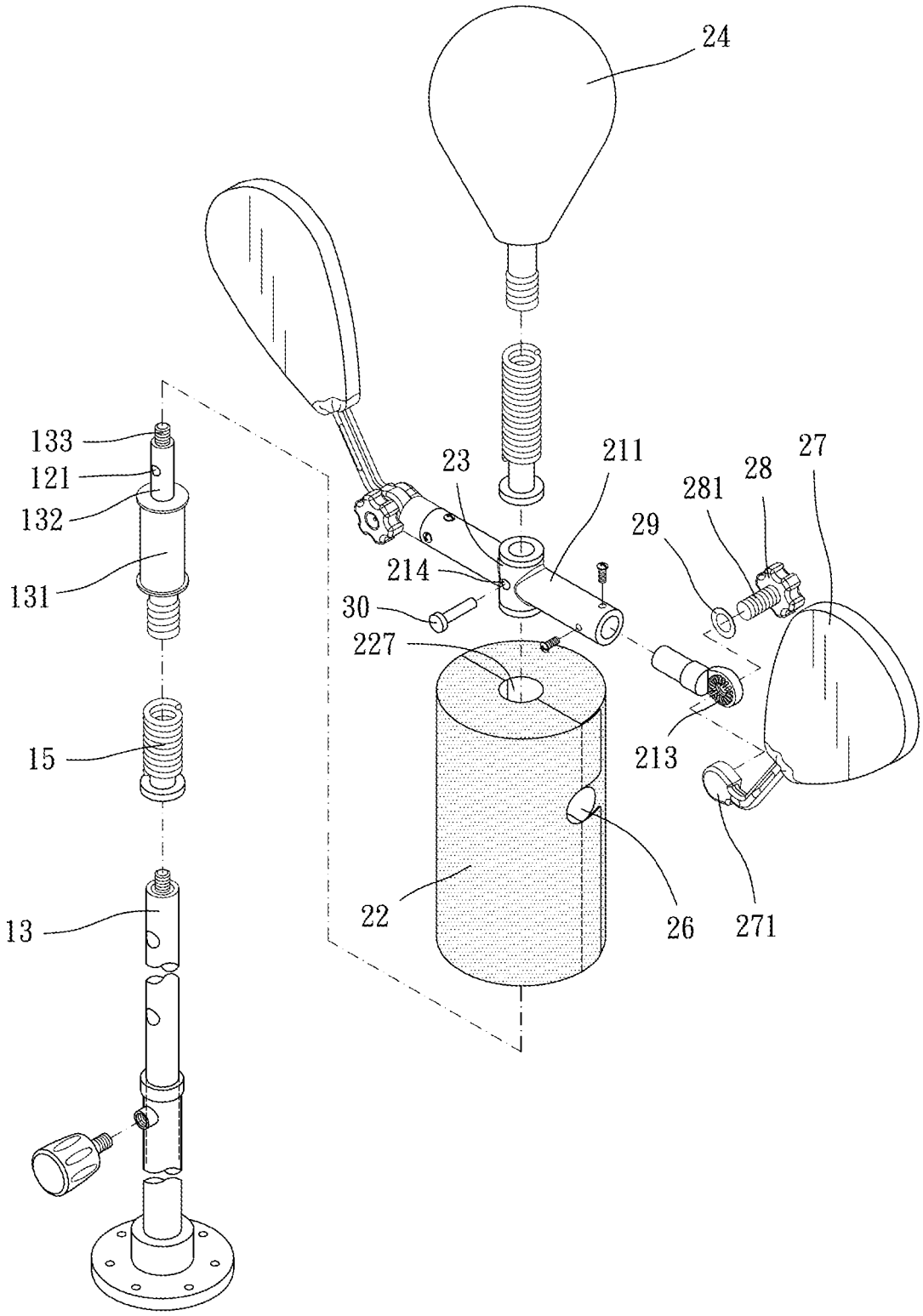
FIG. 7 is a breakdown drawing of another preferable embodiment of the present invention in use.

In an alternative embodiment as shown FIG. 7, the punching mechanism 20 further includes a positioning member 30, the first punched member 21 includes a first positioning portion 214, the assembling end 12 includes a second positioning portion 121, and the positioning member 30 is mounted to the first positioning portion 214 and disengageably connected with the second positioning portion 121. The first positioning portion 214 is a penetrating hole (may be a blind hole), and the positioning member 30 is a pin. The positioning member 30 can be inserted in the first positioning portion 214 and the second positioning portion 121 so that the first punched member 12 is non-rotatable relative to the support body 10; otherwise, the positioning member 30 is disengageable from the second positioning portion 121 so that the first punched member 12 is freely rotatable. In other embodiment, the first positioning portion may be a threaded hole, the positioning member may be a threaded member, the second positioning portion may be a surface, and the positioning member can be screwed with the threaded hole to press on the second positioning portion so that the first punched member is non-rotatable relative to the assembling end.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A punching-training device, including:

a support body, having a seat end and an assembling end; and a punching mechanism, including a first punched member which is freely rotatably assembled to the assembling end and a pad, the first punched member including a body portion disposed around the assembling end, the pad being disposed on and rotatable together with the body portion;

wherein the pad includes two cladding portions which are openably connected with each other, and the body portion is disposed between the two cladding portions;

wherein the pad includes two through holes corresponding to the first punched member;

wherein the pad further includes a penetrating hole, the body portion is received in the penetrating hole, each of the two cladding portions includes a longitudinal groove, the longitudinal grooves of the two cladding portions form the penetrating hole, each of the two cladding portions further includes two lateral grooves, and corresponding two of said lateral grooves of the two cladding portions form one said through hole;

wherein the support body further includes a buffering mechanism, the buffering mechanism is disposed between the seat end and the first punched member, and the pad covers the buffering mechanism.

2. The punching-training device of claim 1, wherein the pad is detachably disposed on the body portion.

3. The punching-training device of claim 2, wherein the pad further includes a bonding structure, the bonding structure includes a male bonding structure and a female bonding structure disengageably connected with the male bonding structure, the male bonding structure is disposed on a first one of the two cladding portions, and the female bonding structure is disposed on a second one of the two cladding portions.

4. The punching-training device of claim 3, wherein the pad further includes a band connected with the first one of the two cladding portions, one of the band and the second one of the two cladding portions includes the male bonding structure, and the other of the band and the second one of the two cladding portions includes the female bonding structure.

5. The punching-training device of claim 4, wherein the male bonding structure is a hook structure, the female bonding structure is a loop structure of Velcro; the band includes a notch; the assembling end further includes a supporting rod and a stop portion, the supporting rod includes a large diameter section, a small diameter shaft connected with the large diameter section, and a connection end disposed at an end of the small diameter shaft, the first punched member is rotatably mounted to the small diameter shaft, the stop portion is detachably connected with the connection end, the pad covers the stop portion; the supporting rod is retractable; the pad further includes an intermediate connection portion connected between the two cladding portions, the two cladding portions are swingable about the intermediate connection portion; the intermediate connection portion is thinner than each of the two cladding portions; the first punched member further includes two arm portions, the body portion is a tubular member, the two arm portions are laterally connected with the tubular member, the pad covers the two arm portions; the two arm portions are disposed respectively at two opposite sides of the tubular member; the two through holes corresponding respectively to the two arm portions, and the two arm portions are received respectively within the two through holes; each of the two arm portions is protrusive outwardly beyond one said through hole; one of the two arm portions is engaged within the notch; the punching mechanism further includes two second punched members, two fasteners and two washers, each of the two arm portions includes a first engagement portion, each of the two second punched members includes a second engagement portion adjustably engaged with the first engagement portion, each of the two fasteners is disposed through one said first engagement portion and one said second engagement portion and serves as a shaft portion, each of the two washers is disposed between one said second punched member and one said fastener, one of the two fasteners is abutted against one said washer, each of the two second punched members is rotatable relative to the first engagement portion.

6. The punching-training device of claim 2, wherein the pad further includes an intermediate connection portion connected between the two cladding portions, and the two cladding portions are swingable about the intermediate connection portion.

7. The punching-training device of claim 1, wherein the first punched member further includes two arm portions, the body portion is a tubular member, the two arm portions are laterally connected with the tubular member, and the pad covers the two arm portions.

8. The punching-training device of claim 7, wherein the two through holes respectively correspond to the two arm portions, and the two arm portions are received respectively within the two through holes.

9. The punching-training device of claim 1, wherein the assembling end further includes a supporting rod and a stop portion, the supporting rod includes a large diameter section, a small diameter shaft connected with the large diameter section, and a connection end disposed at an end of the small diameter shaft, the first punched member is rotatably mounted to the small diameter shaft, the stop portion is detachably connected with the connection end, and the pad covers the stop portion.

10. The punching-training device of claim 1, wherein the punching mechanism further includes a positioning member, the first punched member includes a first positioning portion, the assembling end includes a second positioning portion, and the positioning member is mounted to the first positioning portion and disengageably connected with the second positioning portion.

* * * * *